US006179587B1

(12) United States Patent
Kurth

(10) Patent No.: US 6,179,587 B1
(45) Date of Patent: Jan. 30, 2001

(54) DISPENSING VALVE MOUNTED ON DISPENSING PUMPS

(75) Inventor: Gunter Kurth, Ranstadt (DE)

(73) Assignee: Hassia Verpackungsmaschinen GmbH, Ranstadt (DE)

( * ) Notice: Under 35 U.S.C. 154(b), the term of this patent shall be extended for 0 days.

(21) Appl. No.: 09/313,399

(22) Filed: May 18, 1999

(30) Foreign Application Priority Data

May 19, 1998 (DE) ..... 198 22 430

(51) Int. Cl.[7] ..... F04B 7/00
(52) U.S. Cl. ..... 417/517
(58) Field of Search ..... 417/517, 560, 417/515

(56) References Cited

U.S. PATENT DOCUMENTS 3,228,412 1/1966 Peterson et al. ..... 137/240
3,266,435 * 8/1966 Smith ..... 103/170

FOREIGN PATENT DOCUMENTS 195 04 546 8/1996 (DE) .

* cited by examiner

*Primary Examiner*—Timothy S. Thorpe
*Assistant Examiner*—Ehud Gartenberg
(74) *Attorney, Agent, or Firm*—Collard & Roe, P.C.

(57) ABSTRACT

A dispensing valve comprises a housing defining a cylindrical cavity and feeding and discharge channels communicating with the cavity respectively through feeding and discharge ports. The cylindrical cavity has a diameter larger than the diameter of the feeding and discharge channels and the feeding and discharge ports. A pump intake and ejection port communicates with the cavity, the feeding and discharge channels being arranged substantially opposite the pump intake and ejection port. A closing part comprises an adjusting shaft sealing protruding into the housing and rotatable about an axis, and a cam carried by the adjusting shaft for rotation in the cavity, the cam being oriented toward one side with respect to the adjusting shaft axis and having a closing face extending parallel to the cylindrical wall of the cavity and being rotatable in a cylindrical adjustment plane extending over the feeding and discharge ports. The closing face has a radius which is smaller than the radius of a portion of the cylindrical cavity wall outside the cylindrical adjustment plane, and the closing face has an arc length dimensioned so that the closing face closes the feeding and discharge ports in one rotary position of the cam and, in another rotary position, the closing face extends from one of the rims of the pump intake and ejection port to an inner rim of a respective one of the feeding and discharge ports.

4 Claims, 3 Drawing Sheets

DISPENSING VALVE MOUNTED ON DISPENSING PUMPS

BACKGROUND OF THE INVENTION

1. Field of the Invention

The present invention relates to a dispensing valve on dispensing pumps or to a combined dispensing pump valve for dispensing measured amounts of at least partially liquid material containing solid pieces, such as jam, yogurt or the like, into packaging containers.

2. Description of the Prior Art

A dispensing valve of this type intended for the aforementioned use has been disclosed by German Patent No. 195 04 546. It is true, this prior art dispensing valve also operates like a so-called rotary slide valve (see, e.g. U.S. Pat. No. 3,228,412), however, the operation is such that the cam closes the inlet port like a finger held on an opening, with the said cam being swiveled for opening purposes, thereby releasing a relatively large portion of the housing space. The material dispensed in measured amounts can readily flow, with no plugging risk, about the cam which is in the opening position. The actual dispense in measured amounts is effected by a correspondingly timed actuation of the dispensing valve and a dispensing pump arranged above the orifice of the feeding channel on the valve housing. The operation of the state-of-the-art dispensing valve is absolutely satisfactory regarding the requirement of preventing clogging of material of the aforementioned character and providing, within the housing, in the opening position thereof, a large space of passage.

However, the disadvantage involved resides in that two of such relatively expensive dispensing valves will have to be associated to each dispensing pump, one for the in-take process and one for the discharge operation. Apart from the effort involved therewith, the arrangement of two dispensing valves requiring two separate drives for each dispensing pump will require corresponding space in the area above the filling station of a packaging machine wherein cups can be molded in a web of packaging material, for example, in a timed and continuous way, that are then to be filled, through a dispensing valve, in the filling station of such a machine.

OBJECTS OF THE INVENTION

Proceeding from the dispensing valve of the aforementioned type, it is the object of the present invention—maintaining the advantages involved, including easy cleansing thereof—to so modify and improve a dispensing valve of the afore-described type, that one dispensing valve for the in-take and discharge processes for each dispensing pump will do, with the inlet and outlet ports of the dispensing valve, in addition, being able to be simultaneously closed, if so required.

Another object of the present invention is to arrange the inlet and outlet ports within the housing in a manner as room-saving as possible.

Finally, it is an object of the invention to provide favorable flow conditions in the valve cavity by a special configuration of the closing fit.

SUMMARY OF THE INVENTION

It has now been found that these and other objects and advantages can be obtained by a dispensing valve which—compared to the prior known dispensing valve according to German Patent No. 195 04 546—is characterized in that the two feeding and discharge channels are arranged within the housing substantially opposite an inlet and outlet port of the pump, while the ports of the feeding and discharge channels spaced by an intermediate bridge are arranged in the cylindrical fitting plane of the closing face of the cam, with the radius of the closing face of the cam being smaller than the radius of the cavity externally of the area of the cylindrical plane of arrangement of the two ports, and that the arc length of the closing face is so dimensioned that, with a corresponding position of the cam, at least the two ports are closed or the arc length, at best, extends from one or the other opening rim of the inlet and outlet ports of the pump to the respectively inner opening rim of one or the other port.

Apart from the fact that thanks to the configuration of the dispensing valve of the pump according to the invention, each dispensing pump respectively requires only one valve, the closing portion of which, in permanent operation, will have to perform only a very short oscillating movement between the ports of the feeding and discharge channels, the closing portion in view of the size of its closing face, can be simultaneously placed into the closing position for both ports involving only minimum space requirements for the closing face, with the maximum dimension possible being limited in that, during in-take and discharge, optimum conditions of flow through the flow paths toward the inlet and outlet ports in the housing and away therefrom can be secured.

Preferably, the two feeding and discharge channels are arranged in the vertical direction and in parallel in side-by-side relationship within the housing to obtain, if possible, only weakly bent flow paths in the valve from the in-take side toward the pump and from the pump toward the ejection port.

Finally, an advantageous embodiment yet to be described hereinafter, resides in that the flanks of the cam relative to the axis of oscillation are provided with a concave curvature.

As in the dispensing valve according to German Patent No. 195 04 546, also in the present instance the sharp edges of the closing portion provided in the prior art, for the purpose of chopping of coarser fruit pieces, can be employed.

BRIEF DESCRIPTION OF THE DRAWINGS

Various other objects and advantages of the invention will become manifest from the following detailed description, claims ad drawings appended hereto, wherein

DESCRIPTION OF PREFERRED EMBODIMENTS

Figure 1:
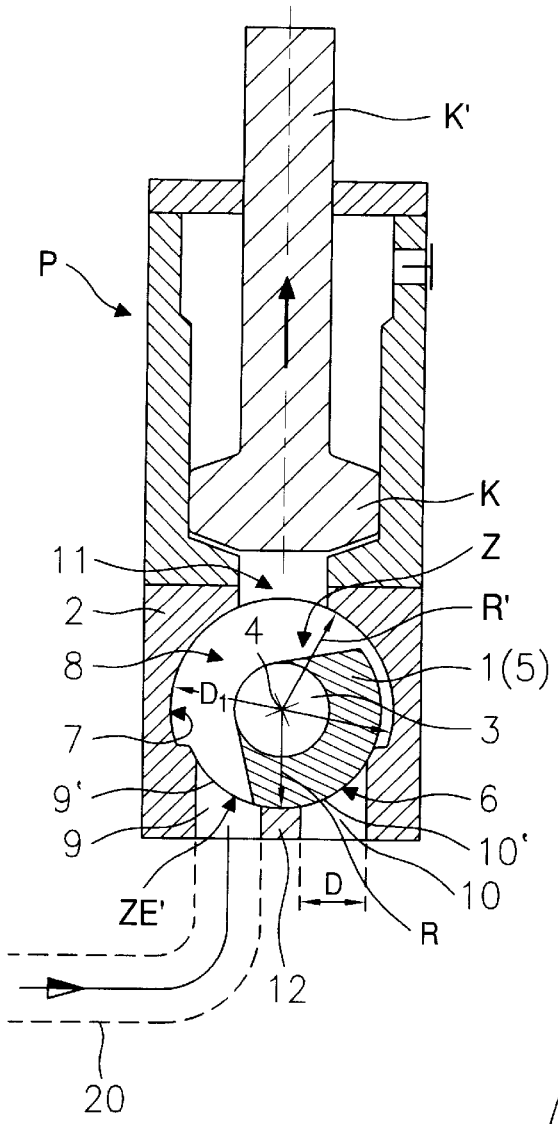
FIG. 1 is a schematically shown sectional view of the dispensing valve in the in-take position.

The dispensing valve especially intended for dispensing measured amounts of at least partially liquid material, such as jam, yogurt or the like, comprises a housing 2 provided with feeding and discharge channels 9, 10, a closing portion 1 swivable in a cylindrical cavity 8 of the housing 2 and having a larger diameter than the diameter D of the feeding and discharge channels 9,10. The said closing portion 1 is formed as a head of an adjusting shaft 3 sealingly protruding into the housing 2 and being of a smaller diameter than the diameter D1 of the cavity 8. The actual closing face 6 of the closing portion 1 extends in parallel to the cylindrical wall 7 of the cavity 8, and the closing portion 1 is in the form of a cam 5 which, relative to the swivel axis 4 of the adjusting shaft 3 is oriented toward one side. The radius R of the closing face 6 of the cam 5 is slightly smaller dimensioned than the radius R' of the cavity 8 externally of the area of the cylindrical plane ZE', in which the two ports 9, 10' extend.

Figure 4:
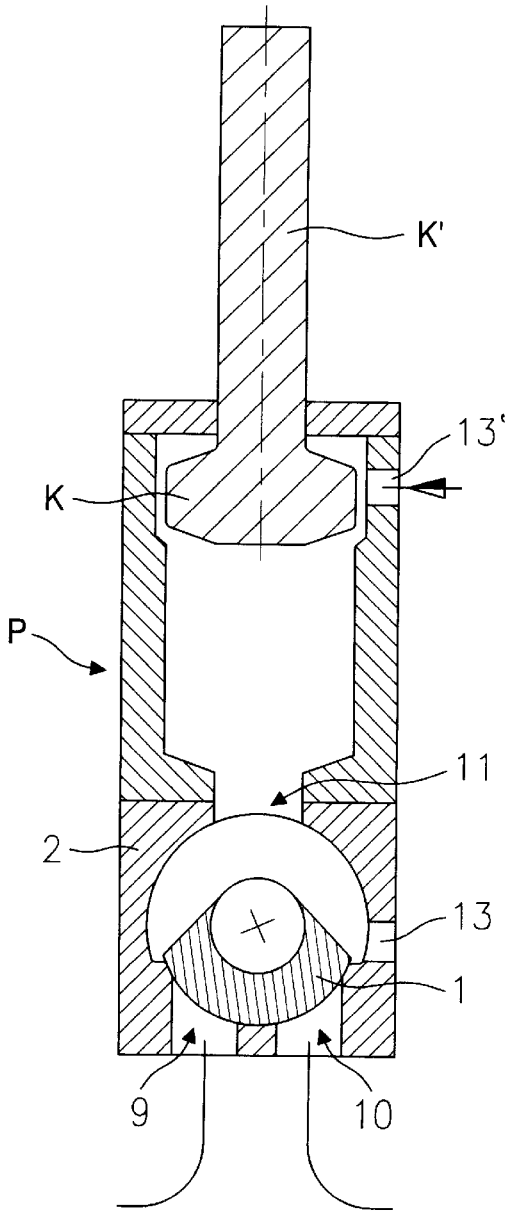
FIG. 4 is a sectional view of the dispensing valve in the totally closed position.

In respect of a dispensing valve of the afore-described type, according to the invention, it is important for the feeding and discharge channels 9,10 to be arranged, in the housing 2, substantially opposite a pump in-take and ejection port 11. The two adjacent ports 9', 10' of the feeding and discharge channels 9,10 spaced from one another by an intermediate bridge 12 are located in the cylindrical plane ZE of the closing face 6 of the cam 5. Moreover, the arc length L of the closing face 6 is so dimensioned that in a corresponding position of the cam 5 at least the two ports 9',10'are closed (complete closing position according to FIG. 4). The largest possible arc length L extends from one of the port rims 11' of the pump in-take and ejection port 11 to the inner port rim 9"', 10"' of a respective port 9', 10' (see FIG. 5).

Figure 6:
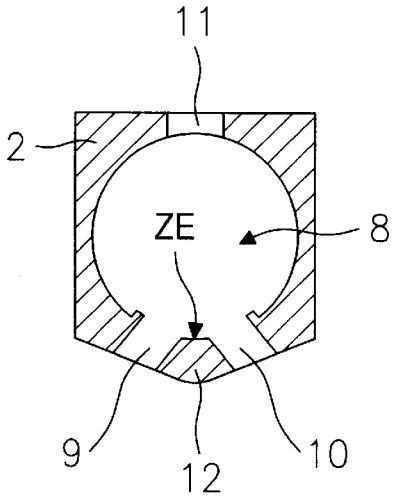
FIG. 6 is a sectional view of a special configuration of the housing.

The phrase "substantially opposite" means that the discharge channels 9,10—as opposed to the illustration in FIGS. 1 through 4—are not necessarily arranged in a direction vertical over the in-take and ejection port 11 and in parallel with respect to one another (which, however, is the preferred arrangement), but they can also be disposed as shown in FIG. 6, with the bottom side of the housing being configured accordingly.

Figure 2:
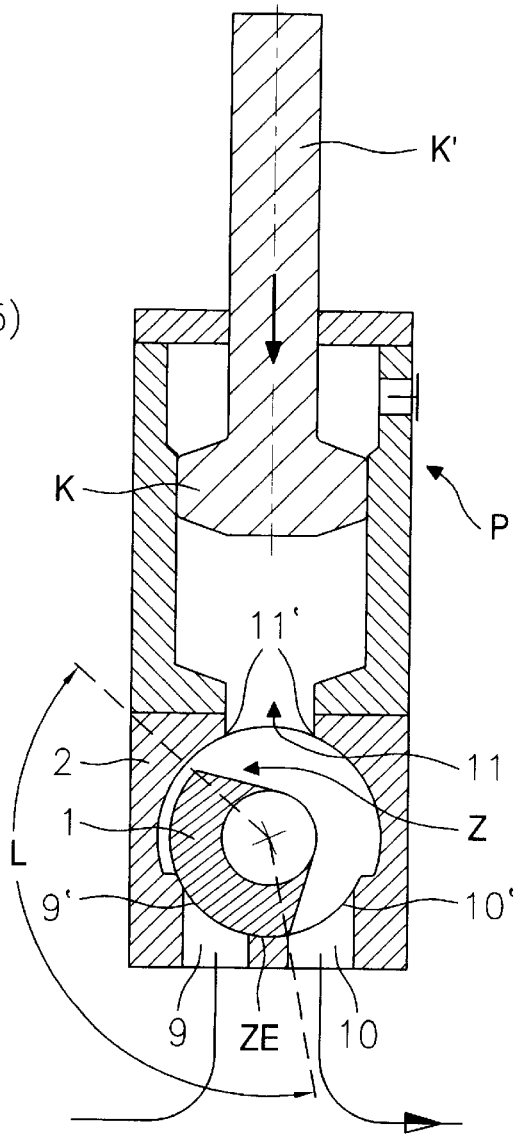
FIG. 2 is a schematically shown sectional view of the dispensing valve in the discharge position.

The driving elements for the piston K of the dispensing pump P and for the adjusting shaft 3 of the dispensing valve have not been shown in any detail. The driving means for the piston K is, for example, a pneumatic cylinder moving the piston rod K' up and down. The driving means for the adjusting shaft 3 is, for example, a servo-motor reciprocating the adjusting shaft 3 and, hence, the cams 5. Both movements are correspondingly controlled as follows:

FIG. 1 shows the in-take position of pump and valve wherein the cam 5 closes the discharge port 10. Once the piston K is lifted in the direction of the arrow, filling material is fed through a conduit 20, passing, via inlet port 9', cavity 8 and port 11, into the dispensing pump P. Once piston K has reached its peak position as shown in FIG. 2, cam 5 is swiveled toward the other side to now close the inlet port 9. Piston K is thereafter moved downwardly in the direction of the arrow, and the filling material to be dispensed in measured amounts is ejected through port 11, cavity 8 and discharge port 10'.

Figure 3:
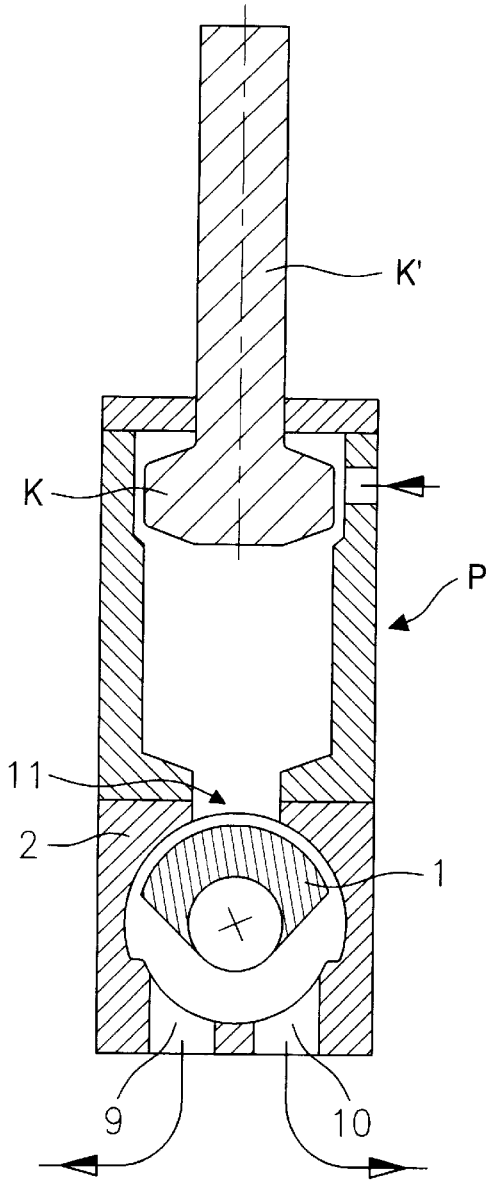
FIG. 3 is a schematically shown sectional view of the dispensing valve in the cleansing position.

For cleaning reasons in case of a change in product, reference is made to FIG. 3. Also in this embodiment of the dispensing valve of the invention, the radius R of the closing face 6 of cam 5 is—as mentioned earlier—smaller dimensioned than the radius R' of the cavity 8 externally of the area of the cylindrical plane ZE' of the ports 9', 10' of the feeding and discharge channels 9,10; however, in this instance, the pump inlet and ejection port 11 is arranged in the area externally of the plane of arrangement ZE', in the center thereof. As shown in FIG. 3, the material to be dispensed in measured amounts can freely flow both about the piston K of the dispensing pump P and about the closing portion 1 of the dispensing valve.

In view of the given total closing capability of the dispensing valve (see FIG. 4), an advantageous embodiment resides in that a closeable detergent connection 13 is provided on the housing 2, leading to the cavity 8. Irrespective of whether the detergent is supplied at the top of the pump P through connection 13' thereof, or vice versa, at the bottom of the detergent connection 13 of the dispensing valve, the pump and the dispensing valve, in case of a product change, can thereby be separately scavenged and/or sterilized.

Figure 5:
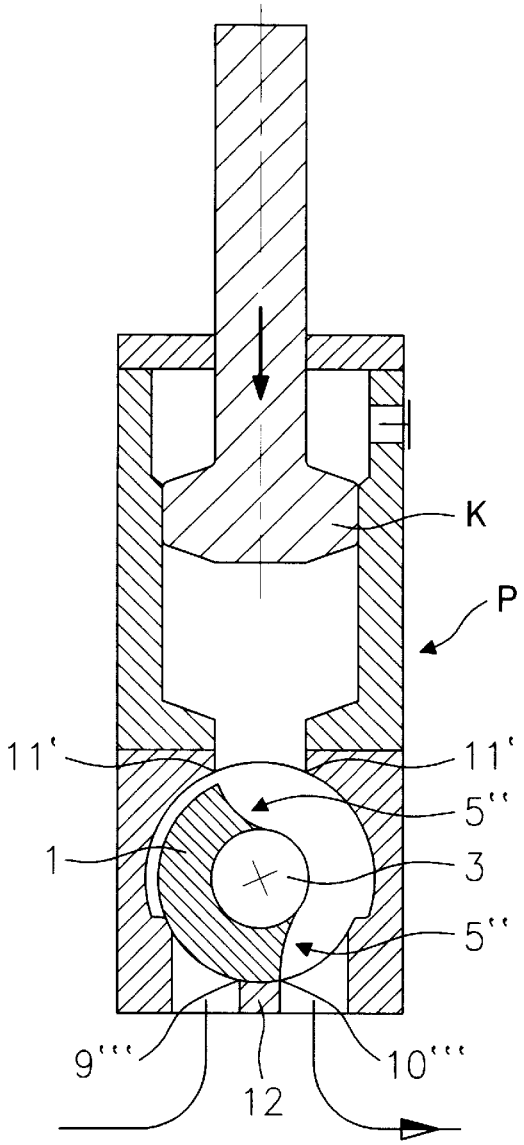
FIG. 5 is a sectional view of the dispensing valve showing a special configuration of the closing portion.

As regards the afore-mentioned embodiment according to which the flanks of the cam 5 relative to the swivel axis 4 are provided with a concave curvature 5", reference is made to FIG. 5. An embodiment of that type involves the advantage that, both in feeding and discharging the filling material from gussets Z or "dead water gussets" (see e.g. FIGS. 1,2) clear and substantially smooth flow spaces or flow channels are formed in housing 2 which in view of a clogging risk while dispensing coarse pieces of fruit, is of some advantage.

Figure 7:
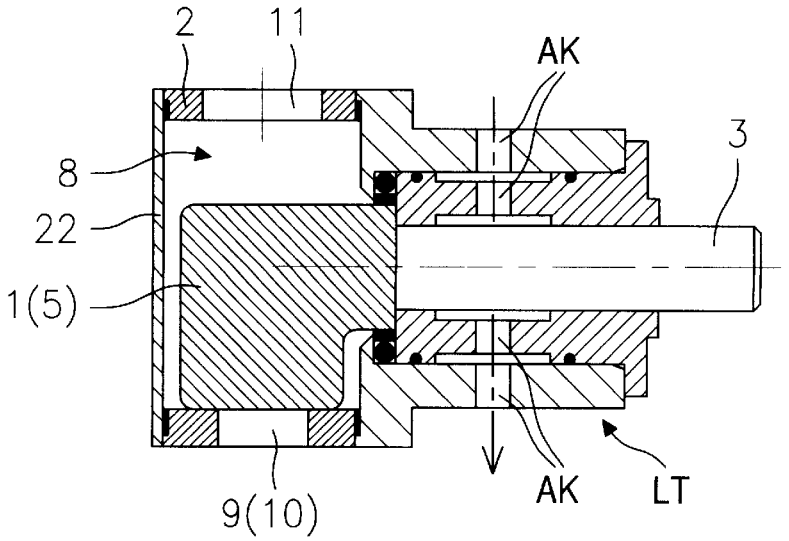
FIG. 7 shows a longitudinal section through the dispensing valve without the dispensing pump.

It is only for the sake of completeness that FIG. 7 shows a longitudinal section through the dispensing valve which is formed of two parts, i.e. of housing 2 completely open toward the driving side which is closed at that side through the mountable bearing part LT for the closing portion 1. Housing 2, toward the other side, is simply closed by plate 22 that can be easily opened in case of an unexpected clogging. The required bolting between bearing part LT and housing 2; between plate 22 and housing 2; and between pump P and housing 2 have not been shown in any detail. If a sterile operation is required, the bearing part LT is provided with connections and channels AK for passing a suitable sterilizing agent theretbrough.

It will be understood that the afore-going description with the details of an exemplary structure is not be construed in any way to limit the invention, but modifications may be made thereto without departing from the spirit and scope of the invention as set forth in the following claims.

What is claimed is:

1. A dispensing valve mounted on a dispensing pump, which comprises (a) a housing defining (1) a cylindrical cavity having a cylindrical wall and (2) a feeding channel and a discharge channel communicating with the cavity respectively through a feeding port and a discharge port, the cylindrical cavity having a diameter larger than the diameter of the feeding and discharge channels and the feeding and discharge ports being separated by an intermediate bridge, and (3) a pump intake and ejection port communicating with the cavity, the feeding and discharge channels being arranged substantially opposite the pump intake and ejection port; and (b) a closing part comprising (1) an adjusting shaft sealing protruding into the housing and rotatable about an axis, and (2) a cam carried by the adjusting shaft for rotation in the cavity, the cam being oriented toward one side with respect to the adjusting shaft axis and having a closing face extending parallel to the cylindrical wall of the cavity and being rotatable in a cylindrical adjustment plane extending over the feeding and discharge ports, the closing face having a radius which is smaller than the radius of a portion of the cylindrical cavity wall outside the cylindrical adjustment plane, and the closing face having an arc length dimensioned so that the closing face closes the feeding and discharge ports in one rotary position of the cam and, in another rotary position, the closing face extends from one of the rims of the pump intake and ejection port to an inner rim of a respective one of the feeding and discharge ports.

2. The dispensing valve of claim 1, wherein the feeding and discharge channels extend vertically and are arranged parallel and adjacent each other.

3. The dispensing valve of claim 1, wherein the cam has flanks having a concave curvature relative to the axis of the adjusting shaft.

4. The dispensing valve of claim 1, further comprising a cleaning medium connection on the housing for feeding a cleaning medium to the cavity.

* * * * *